United States Patent [19]

Zelli

[11] Patent Number: 4,953,858

[45] Date of Patent: Sep. 4, 1990

[54] SLOPING ROTATABLE EXERCISER

[75] Inventor: Joseph M. Zelli, Houston, Tex.

[73] Assignee: Michael P. Breston, Houston, Tex.; a part interest

[21] Appl. No.: 928,552

[22] Filed: Nov. 10, 1986

[51] Int. Cl.[5] ..... A63B 21/04

[52] U.S. Cl. ..... 272/146; 272/97; 272/136

[58] Field of Search ..... 272/97, 146, 96, 144, 272/66; 434/253; D21/193; 128/25 R, 25 B

[56] References Cited

U.S. PATENT DOCUMENTS

| | | | |
|---|---|---|---|
| 3,582,066 | 6/1971 | Keryluk | 272/97 |
| 3,612,519 | 10/1971 | Larson | 272/146 |
| 4,199,137 | 4/1980 | Giguére | 272/96 |
| 4,200,282 | 4/1980 | Agyagos | 128/25 B X |
| 4,313,603 | 2/1982 | Simjian | 272/146 |
| 4,323,231 | 4/1982 | Wilson | 272/144 X |
| 4,396,189 | 8/1983 | Jenkins | 272/97 |
| 4,429,869 | 2/1984 | Eckstein | 272/97 |
| 4,607,839 | 8/1986 | Knudson | 272/97 |

FOREIGN PATENT DOCUMENTS

| | | | |
|---|---|---|---|
| 204939 | 1/1952 | Austria | 272/97 |

*Primary Examiner*—Richard J. Apley
*Assistant Examiner*—H. N. Flaxman
*Attorney, Agent, or Firm*—Michael P. Breston

[57] ABSTRACT

The exerciser is adapted to simulate the motions and conditions incident to making turns on a ski slope, and for perfecting body movements that are important for the safety of skiers on a snow-covered slope. The exerciser has a platform for supporting a person and a support including a frame for supporting the platform for rotation in accordance with shift of weight and movements of the person. Restraining spring is coupled between the platform and the frame. The spring is effective to yieldably resist with increasing force the increasing tendency of the platform to rotate clockwise or counter-clockwise from a neutral position relative to the frame.

19 Claims, 2 Drawing Sheets

SLOPING ROTATABLE EXERCISER

1. FIELD OF THE INVENTION

This invention relates in general to body exercising devices and, more particularly, to a sloping rotatable exerciser which functions to simulate the motions and conditions incident to making turns on a ski slope.

2. BACKGROUND OF THE INVENTION

Various such devices are already known which are useful in providing exercises for skiing. When used in the home by the average person, such devices generally suffer from one or more deficiencies: they are complex and therefore costly to construct, they do not allow full simulation of the conditions incident to making actual turns on a ski slope, and they cannot easily be moved to suit the convenience of the user or stored when not in use, or when in use they take up a large floor space.

Therefore, there is still a need for a muscle exerciser which is safe, substantially trouble-free, and which enables a person of practically any age to exercise the lower body muscles in substantially the same manner as in actual skiing, but permitting such exercise to take place with a minimum investment in the equipment, and without the use of external devices such as pulleys and weights.

The novel exerciser can be used in homes, gyms, ski lodges and other such establishments which house or are likely to be frequented by skiers. Because it is relatively simple and compact, it can be set up in any room or transported for use at a different location, and when not in use it can be readily stored in a closet.

Accordingly, it is a main object of this invention to provide a new and unique approach to solving ski exercise problems which, although heretofore recognized, have not been effectively addressed in this field.

It is a further object (1) to provide a simple and yet very effective sloping rotatable exerciser for perfecting body movements that are important for the safety of skiers on a snow-covered slope during a downhill run, (2) to allow for adequate muscle strengthening, and (3) to condition and prepare skiers to carry out more or less automatically swaying movements, one-footed skiing, and other movements of the type normally expected from a downhill skier while making turns.

It is yet another object to provide an exerciser which can serve even the accomplished skier to develop and maintain his muscle tone and coordination, and to simulate exactly the sequence of movements necessary to properly execute ski turns on the slopes. In this manner, the user becomes aware of the conditions which develop in response to stressing of certain groups of body muscles.

SUMMARY OF THE INVENTION

The exerciser is adapted to simulate the motions and conditions incident to making turns on a ski slope, and for perfecting body movements that are important for the safety of skiers on a snow-covered slope during a downhill run, and to condition and prepare skiers to carry out swaying movements, one-footed skiing, and other movements of the type normally expected from a downhill skier while making turns. The exerciser has a platform for supporting a person and a support means including a frame for supporting the platform for rotation in accordance with shift of weight and movements of the person. Restraining means are coupled between the platform and the frame. The restraining means are effective to yieldably resist with increasing force the increasing tendency of the platform to rotate clockwise or counter-clockwise from a neutral position relative to the frame.

DESCRIPTION OF A PREFERRED EMBODIMENT

Figure 1:
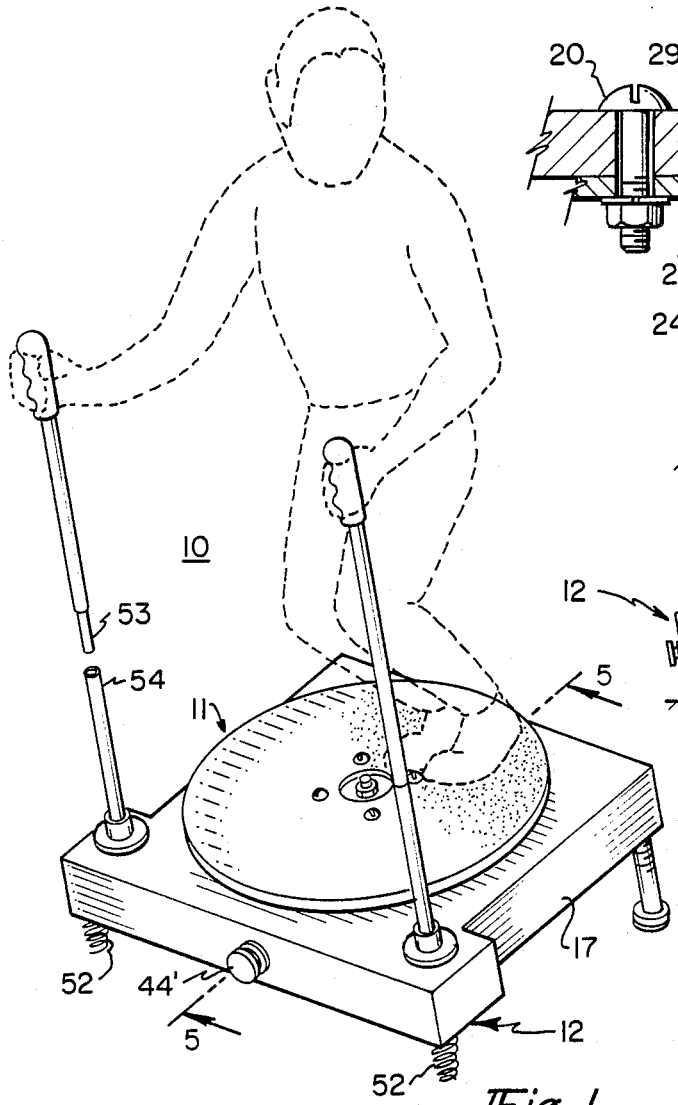
FIG. 1 is a perspective view of the novel sloping rotatable exerciser embodying the features of the present invention showing a person standing on the platform ready to exercise from the neutral position.
Figure 6:
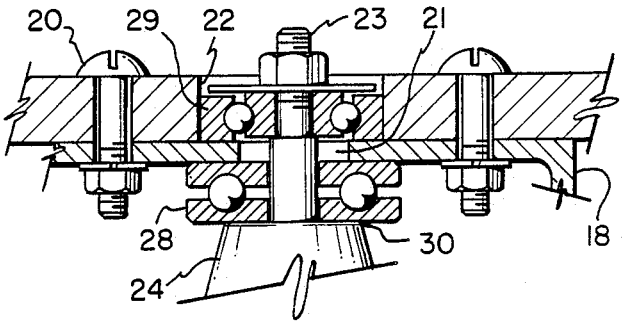
FIG. 6 is an enlarged partial sectional view taken on line 6—6 in FIG. 5.

The sloping rotatable exerciser, generally designated as 10 (FIGS. 1–2), is designed particularly for preparing persons to make turns while skiing on snow or water. It has a platform, generally designated as 11, which is mounted for rotation on a frame 12 that is adapted to rest on a flat surface or floor 13. Platform 11 carries underneath a drum or shaft box 14.

Suitable adjustable lifting means, such as a nut-and-bolt device 15, allows the rear end of frame 12 to become adjustably elevated above floor 13, whereby the user can stand and exercise on platform 11 at a comfortable angle A relative to the horizontal which suitably simulates a snow slope for downhill skiing.

Frame 12 has a vertical wall 16 and a bottom wall 17. The top surface of platform 11 is textured to prevent slippage of the user's shoes or feet.

Figure 5:
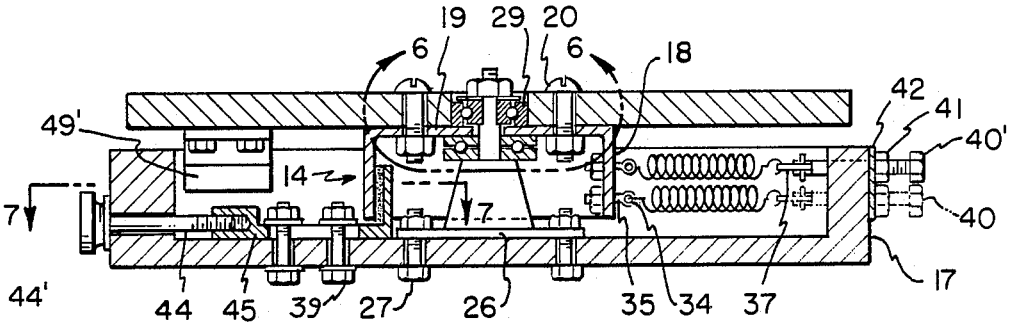
FIG. 5 is a sectional view taken on line 5-5 in FIG. 1.

Upside down drum 14 consists of a cylindrical wall 18 (FIG. 5) and a circular bottom 19 which is secured to platform 11 by nuts-and-bolts 20. Bottom 19 has a center hole 21 which is concentric with a center bore 22 in platform 11.

A vertical shaft 23 extends upwardly from a conical beam 24 which is secured to the center of base 25 of frame 12 by a plate 26 and bolts 27.

Vertical shaft 23 extends through a pair of bearings 28,29. Bottom bearing 28 lies between a shoulder 30 on beam 24 and the inner surface of wall 18, and top bearing 29 rests within bore 22 upon the outer surface of wall 19.

Bearings 28,29 support sloping platform 11 as well as the weight of the user thereon and permit platform 11 to rotate. Shaft 23 defines for sloping platform 11 a vertical axis 31 about which platform 11 is rotatable relative to stationary frame 12 either clockwise or counterclockwise within prescribed angular limits.

Figure 3:
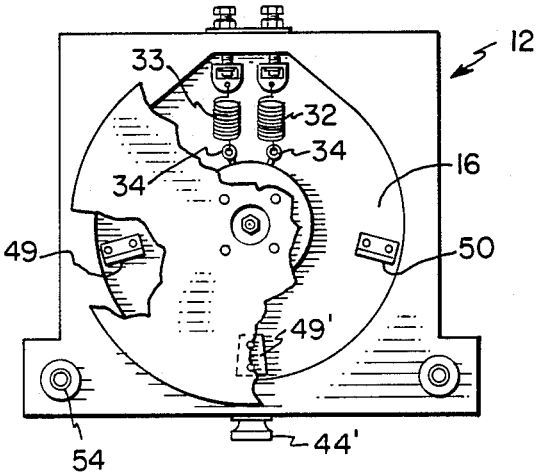
FIG. 3 is a top view of the exerciser shown in FIG. 1, parts being broken away from the platform to show the springs in their neutral position.

A pair of coil springs 32,33 are coupled between cylinder 18 and the confronting face of wall 17 on frame 12 for resiliently resisting rotation of platform 11 relative to a neutral position shown in FIG. 3. While the resilient means are shown as coil springs, other resilient means which will resist rotation of drum 14 can be also employed.

The opposite end hooks of nearly parallel springs 32,33 are connected to eyelets 34 on bolts 35 secured to cylinder 18, and to eyelets 37 on threaded bolts 40. Each bolt 40 threadedly engages a stationary nut 41 secured to a bracket 42 on wall 17 of frame 12. The angular rotation of each bolt 40 is done by turning knob 40' which sets the amount of tension within the spring attached thereto, and hence the amount of reactive resistance to rotation offered by the spring when the user tries to rotate platform 11 away from its neutral position. The initial spring tension of each coil spring 32 or 33 can be adjusted by rotating knob 40', in this manner exerciser 11 can be made to accommodate users of varying size and weight.

Springs 32,33 can be arranged at a wide angle to each other to provide the needed resistance to rotation. For example, instead of being parallel, springs 32,33 can be disposed in opposite directions. Also, the springs can have different stretching characteristics so as to effectively offer resistance to clockwise and counterclockwise rotation starting from different angular positions of platform 11. For example spring 32 can restrain rotation of drum 14 from the neutral position relative to frame 12, while spring 33 can start offering resistance only after platform 11 has been rotated say by 20°.

In use, the springs deform and stretch, and their individual characteristics are selected so as to provide a measured and increasing resistance.

Figure 7:
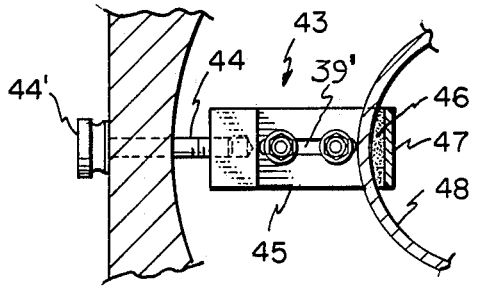
FIG. 7 is a sectional view taken on line 7-7 in FIG. 5 showing the drum braking mechanism.

Adjustable braking to the rotation of drum 14 can also be provided by a braking mechanism 43 (FIG. 7) which includes a screw 44 having a knob 44' that is threadedly connected to an L-shaped plate 45 which carries a friction pad 46 on its upright leg 47. Plate 44 has a longitudinal slot 39' through which extend a pair of bolts 39 which movably secure the plate to bottom wall 16 of frame 12. Rotation of knob 44' moves pad 46 away from or toward the smooth inner surface 48 of cylinder 18 thereby controlling the friction exerted by pad 46 against surface 48.

Figure 4:
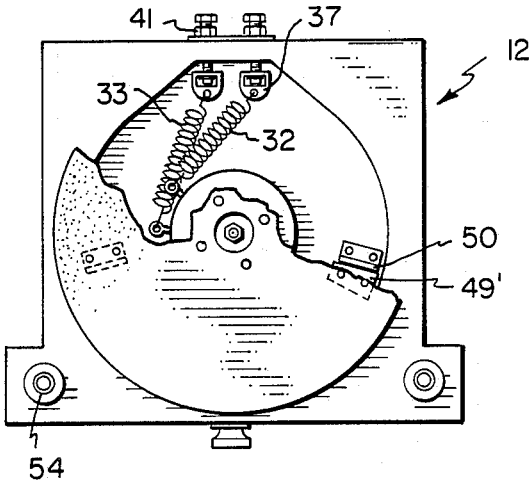
FIG. 4 is a top view of the exerciser similar to FIG. 3, wherein the springs are stretched and the platform has reached its rotation limit.

The rotation of platform 11 is limited by a pair of stop members 49,50 (FIGS. 3,4) secured to base 16 of frame 12 and by a stop member 49' mounted underneath platform 11. Stop members 49, 49' and 50 stop the rotation of platform 11 when it is angularly displaced to its maximum limit (FIG. 4) in either angular direction. This maximum angular limit is selected to provide a meaningful range of platform rotation.

A pair of front coil springs 52 (FIG. 1) are attached to the opposite front corners of frame 12 to allow springs 52 to act as shock absorbers for frame 12 thereby simulating the flexing of skis.

A pair of simulating ski poles 53 (FIG. 1) are rotatably received within tubular members 54 which are secured to the front edge of frame 12. Poles 53 provide to the user the necessary support in exercising and in simulate the desired skiing conditions.

Figure 8:
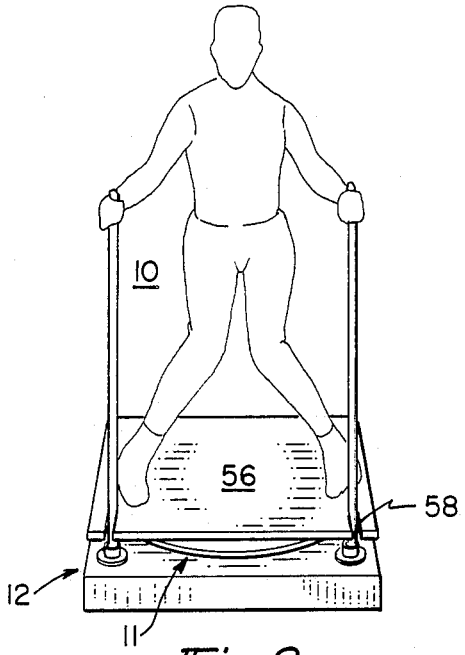
FIG. 8 is a front view of the sloping platform shown carrying a jumping deck.
Figure 9:
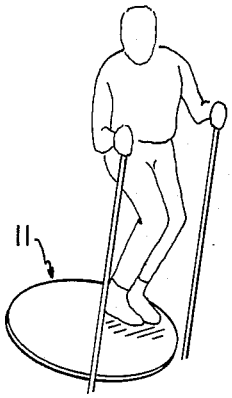
FIGS. 9 through 12 diagrammatically illustrate different body positions assumed by the person on the rotatable sloping exerciser.
Figure 10:
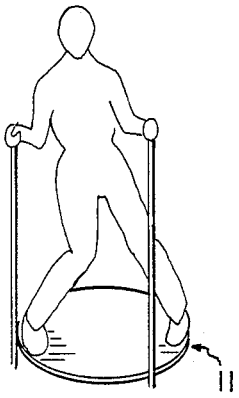
Figure 11:
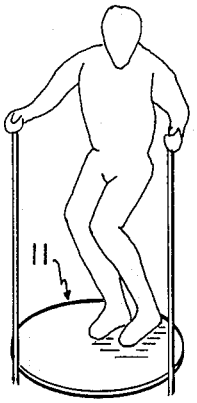
Figure 12:
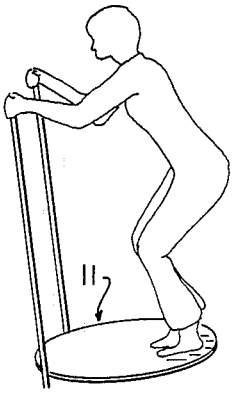

In addition to exercising on platform 11, there is also provided an auxiliary deck 56 (FIG. 8) having notches 58, which receives poles 53 therein. Platform 11 supports the weight of deck 56.

In snow or water skiing the control of the direction of motion of the skis is obtained by leg and body shifting and rotation.

Any rotation of the skis involves a very pronounced twisting of the feet and legs and in so doing the skier changes the angle of his skis with respect to their direction of motion, whether that motion is due to sliding downhill, or to the traction of a boat behind which he is being pulled.

When the skier bends his knees forward and slightly inward, he causes the skis to ride on their inside edges, thus digging into the snow on the slope. This position is sometimes referred to as "edging," and by varying the edge angle the skier can control the speed down the slope.

A skier can edge his skis primarily through banking or leaning to the inside of the turn. By twisting his knees and hip joints, the expert skier allows for more pronounced edging, better flexibility for terrain absorption, and better balance.

Thus, ski turning requires the automatic accomplishment of certain precise and coordinated body movements that the beginner finds difficult to execute while on the snow slope for the reason that his attention is divided between the movements to be accomplished and the feeling of slipping that he faces on the slope.

Ski turning also requires unweighting the internal ski while concurrently increasing the weight on the external ski, and at the same time inclining the ski more or less to set the edge angle of the ski according to the condition of the snow.

By standing on one foot instead of two, the skier doubles the weight on one ski and thus doubles the force available to flex and bend the ski causing it to follow a rounded arc in the turn which produces a braking action that slows the skier down.

In using the sloping exerciser 10, the skier will attempt to carry out simulated skiing motions (FIGS. 9–12) on sloping platform 11. His feet will assume positions on platform 11 so as to simulate for example "snow plow" or "stem" turns which are performed when a skier places his two skis in a V-shaped pattern with the front tip of the skis close to each other and the rear tails of the skis widely separated.

Such body motions tend to rotate platform 11 because they transmit thereto turning forces or moments through the skier's feet. These moments must be strong enough to overcome the resistance of springs 32,33 as well as the braking action of pad 46.

When the skier turns from one side to another about the rotation axis 31 or makes a change in his posture or weight distribution on platform 11, platform 11 will rotate depending on the slope of frame 12 and the weight of the skier.

Newton's laws of motion state that when the user exerts a force on sloping platform 11, this force is resisted by an equal an opposite force developed by springs 32,33, and the inertia and friction of platform 11. This resistive force tends to limit the movement of sloping platform 11 relative to frame 12.

The learning process is rapid, effective, enjoyable, and requires a minimum of training for obtaining optimum results.

Grasping the artificial ski poles 53, the user may engage in conventional stretching and all turn-making exercises.

The rotation of sloping platform 11 simulates a right turn or a left turn with respect to the direction of presumed travel represented by its slope.

Figure 2:
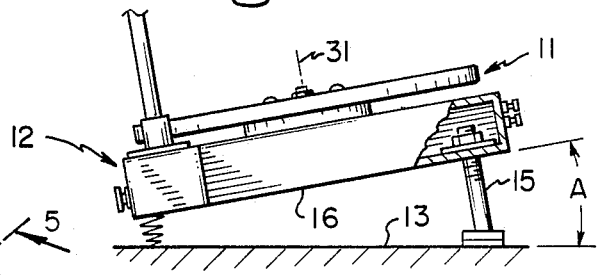
FIG. 2 is a view in side elevation of the exerciser shown in FIG. 1, parts being broken away from the frame to disclose details of angular adjustment.

In so doing, the skier learns to maintain his balance on platform 11 while his legs twist as in the execution of a turn on a downhill slope. Difficulty in maintaining balance increases with the slope angle A (FIG. 2).

All of the parts of the skier's body can be caused to be moved sequentially through the precise positions of balance necessary to execute parallel turns, exactly as would be experienced on a snow-covered slope.

The skier can shift his body weight, lift or lower the right or the left foot, increase or decrease his weight on each foot, move them nearer to or further away from each other, etc. Rotation of platform 11 simulates the true feeling experienced while turning on skis.

Such body motions are beneficial to improve the muscle tone of the feet, ankles, legs, trunk and back.

On auxiliary deck 56 (FIG. 8), the skier may hold his feet together, hold on to poles 53, and then carry out jumping exercises.

Therefore, it can be seen that the sloping exerciser 10 of this invention successfully accomplishes its objectives by virtue of its simplicity, rigidity, and versatility. It is capable of many varied uses for body exercising especially the lower portion of the body. Its use is therefore not limited to skiers.

What I claim is:

1. An exerciser to simulate the motions and conditions incident to making turns on a ski slope, and for perfecting body movements that are important for the safety of skiers on a snow-covered slope during a downhill run, and to condition and prepare skiers to carry out swaying movements, one-footed skiing, and other movements of the type normally expected from a downhill skier while making turns, comprising:

a platform for supporting a person;

support means including a frame;

a shaft fixedly mounted on said frame;

bearing means mounted on and supported by said shaft, and said bearing means and said shaft supporting the entire weight of said platform for substantially frictionless rotation in accordance with shift of weight and movements of the person; and elastic rotation restraining means coupled between said platform and said frame, said restraining means being effective to yieldably resist with increasing force the increasing tendency of the platform to rotate clockwise or counter-clockwise from a neutral start position relative to the frame.

2. The exerciser of claim 1, wherein said support means include a drum secured to the underside of the platform; and said restraining means being mounted between the drum and the frame.

3. An exerciser for simulating the motions and conditions incident to making turns on a ski slope, for perfecting body movements that are important for the safety of skiers on a snow-covered slope during a downhill run, and for conditioning and preparing skiers to carry out swaying movements, one-footed skiing, and other movements of the type normally expected from a downhill skier while making turns, comprising:

a platform for supporting a person;

a drum secured to the underside of said platform, said drum having a cylindrical wall and a circular bottom having a center bore; and said circular bottom being secured to the underside of said platform;

support means including a frame;

a shaft fixedly mounted on said frame, and the shaft's axis extending through said center bore;

bearing means mounted on and supported by said shaft;

said bearing means and said shaft supporting the entire weight of said platform for substantially frictionless rotation in accordance with the shift of weight and movements of said person; and elastic rotation restraining means mounted between said drum and said frame, and said restraining means being effective to yieldably resist with increasing force the increasing tendency of said platform to rotate clockwise or counter-clockwise from a neutral start position relative to said frame.

4. A body exerciser apparatus, comprising:

a platform structure including a generally circular platform;

a shaft fixedly mounted on a stationary support means;

a generally cylindrical shaft box for coupling said shaft to said platform;

said shaft box having a cylindrical outer wall and a circular bottom secured to and under said platform;

said circular bottom having a center bore through which said shaft extends; said center bore having an axis which is coaxial with the shaft's axis; and said shaft and the wall of said center bore defining an annular space therebetween;

bearing means mounted on and supported by said shaft for journaling said platform structure on said shaft for substantially frictionless rotation about an axis of rotation which is coincident with said shaft axis, whereby said bearing means and said box transmit all the reaction forces from said shaft to said platform; and elastic rotation resisting means operatively anchored between said platform structure and said support means for elastically resisting the angular rotation of said platform structure from a start position and up to a maximum angular excursion, in opposite angular directions relative to said start position, thereby enabling a person to carry out body exercises while standing on top of said platform structure by imparting to said platform structure, through his feet and under increasing stress, a reciprocating angular rotation which is being progressively and elastically resisted by said rotation resisting means.

5. The exerciser of claim 3, wherein said restraining means comprises at least one spring.

6. The exerciser of claim 5, and means for adjusting the initial tension within the spring.

7. The exerciser of claim 6, and a pair of simulating ski poles extending upwardly from the front edge of the frame.

8. The exerciser of claim 7, and an auxiliary jumping deck removably mounted over the platform to allow the person to carry out jumping exercises while rotating his legs and holding on to said poles.

9. A body exerciser apparatus, comprising:

a platform structure;

a shaft fixedly mounted on a stationary support means;

bearing means mounted on and being supported by said shaft for journaling said platform structure on said shaft for substantially frictionless rotation about an axis of rotation which is coincident with said shaft axis; and elastic rotation resisting means operatively anchored between said platform structure and said support means for elastically resisting the angular rotation of said platform structure from a start position and up to a maximum angular excursion in opposite angular directions relative to said start position, thereby enabling a person to carry out body exercises while standing on top of said platform structure by imparting to said platform structure, through his feet and under increasing stress, a reciprocating angular rotation which is being progressively and elastically resisted by said rotation resisting means.

10. The body exerciser apparatus according to claim 9, in which said platform structure includes a platform and a shaft box for and for coupling said shaft to said platform.

11. The body exerciser apparatus according to claim 10, in which said platform has a generally circular configuration and said box has a generally cylindrical configuration; and said axis of rotation extends through the centers of said platform and of said box.

12. The body exerciser apparatus according to claim 9, in which said rotation resisting means include spring means anchored between said platform structure and said support means.

13. The body exerciser apparatus according to claim 10, in which said rotation resisting means include spring means anchored between said box and said support means.

14. The body exerciser apparatus according to claim 13, in which said rotation resisting means include spring means anchored between said box and said support means.

15. The body exercise apparatus according to claim 12, in which said spring means include a stretchable, elongated, linear coil spring having an axis which is substantially perpendicular to said shaft axis.

16. The body exerciser apparatus according to claim 12, in which said spring means include a stretchable, elongated, linear coil spring which generates mostly tangential forces against said platform structure.

17. The body exerciser apparatus according to claim 12, in which the interaction between said spring means and said platform structure continuously generates an increasing and mostly reactive torsional moment without an accompanying substantial reactive vertical component force, as said platform structure rotates away from said start position.

18. The body exerciser apparatus according to claim 13, in which the interaction between said spring means and said box continuously generates an increasing and mostly reactive torsional moment without an accompanying substantial reactive vertical component force, as said platform structure rotates away from said start position.

19. A body exerciser apparatus, comprising:

a rigid and generally-circular platform structure;

a stationary support means including a floor-mounted base;

a shaft having a lower end fixedly mounted on said base, said shaft having an axis extending through the center of gravity of said platform structure;

coupling means coupling said platform structure to said shaft, said coupling means including bearing means having rolling bearing elements mounted on and supported by said shaft for journaling said platform structure on said shaft for substantially frictionless rotation about an axis of rotation which is coincident with said shaft axis, whereby the entire weight of said platform structure is being supported by said bearing means and by said shaft, the upper surface of said platform structure rotating in a single plane, and the lower surface of said platform structure being elevated about said base so as to define an unobstructed area around said shaft between said platform structure and said base; and elastic rotation resisting means including spring means operatively anchored within said unobstructed area between said platform structure and said support means for elastically resisting the angular rotation of said platform structure from a start position and up to a maximum desired angular excursion in opposite angular directions relative to said start position, thereby enabling a person to carry out body exercises while standing on said upper surface by imparting to said platform structure, through his feet and under increasing stress, a reciprocating angular rotation which is being progressively and elastically resisted by said rotation resisting means.

* * * * *